US006171221B1

(12) United States Patent
Hayduk

(10) Patent No.: US 6,171,221 B1
(45) Date of Patent: Jan. 9, 2001

(54) FITNESS EXERCISE UNIT HAVING A SPRING-CONTROLLED EXTENSION CLAMP

(76) Inventor: Michael C. Hayduk, 1407 Burns Ave., Toms River, NJ (US) 08753

( * ) Notice: Under 35 U.S.C. 154(b), the term of this patent shall be extended for 0 days.

(21) Appl. No.: 09/406,125

(22) Filed: Sep. 27, 1999

(51) Int. Cl.[7] ..... A63B 21/072

(52) U.S. Cl. ..... 482/139; 482/93; 482/106; 482/108; 16/422; 294/16

(58) Field of Search ..... 482/92, 93, 99, 482/102, 103, 106–108, 139; 16/422; D21/694; 294/15, 16

(56) References Cited

U.S. PATENT DOCUMENTS 1,625,255 * 4/1927 Hudgins ..... 234/16
4,720,096 * 1/1988 Rogers ..... 482/106
5,613,928 * 3/1997 Lavdone ..... 482/139

* cited by examiner

*Primary Examiner*—John Mulcahy
(74) *Attorney, Agent, or Firm*—Charles I. Brodsky

(57) ABSTRACT

A pair of extension bars join together in forming a tubular clamp having a raised wall surface, with the extension bars having angularly adjustable stirrups through which the arms of the user pass in grasping onto a pair of handle members, with one extension bar having a spring actuated finger pull to latch onto the raised wall in closing the tubular clamp in coupling to a weight bar, or in separating the tubular clamp when proceeding to couple to a different weight bar. The distance from the handle member to the clamp affords a lever action to increase resistance range without increasing any weight being exercised with, as well as working muscle at lower ranges of motion.

9 Claims, 3 Drawing Sheets

FITNESS EXERCISE UNIT HAVING A SPRING-CONTROLLED EXTENSION CLAMP

FIELD OF THE INVENTION

This invention relates to fitness exercise units, in general, and to a type of extension bar attractive for use in fitness centers, health spas and gyms, and by home gym owners, in particular.

BACKGROUND OF THE INVENTION

A person need only take a one-two minute tour of an operating fitness center, spa, or gym to observe the many different kinds of apparatus available for use. Taking a second walk-around the facility, the observer will note that many of the professional equipments are used primarily by patrons interested in body building, while other equipments are primarily used for rehabilitation exercising. Upon reflection, it would therefor become desirable if a fitness exercise unit could be had which would prove beneficial to both these classes of patrons at the center, as well as to other members who are just interested in maintaining good health. It would also be desirable, furthermore, if such a fitness exercise unit could be had for use by a home gym owner, and which could be transported about easily, from place-to-place.

SUMMARY OF THE INVENTION

As will become clear from the following description, the fitness exercise unit of the present invention incorporates a spring-controlled, extension clamp, along with adjustable arm stirrups and handles for use in doing such exercises as bent-over rows, squats and lateral movements. As will also become clear below, many advantages follow from the construction:

1. By providing an extension clamp, more muscle can be worked at a lower range of motion for the same opposing weight; at the same time, by means of the extension clamp, the resistance range can be increased, again without increasing the weight.

2. Less stress is produced on the wrists, while providing an increased range of motion for the weight then being handled.

3. A wide variety of exercises can be performed, utilizing conventional barbells, pull-up bars, dumbbells, and any other type of weight bar in a manner to allow a the user to get under the center of gravity in lessening the bending over of the back, thereby reducing stress on the lumbar musculature.

4. With the spring-controlled extension clamp, a quick-lock mechanism results in allowing a circuit of exercise equipment to be made without stopping to adjust pins, locks or other weights in changing from one exercise to another.

5. With the arm stirrups being adjustable, and with the handle positioning to be described, the wrists of the user are held in a neutral position, without pronation or supination, for increased safety both for the wrists and for the arms.

6. The fitness exercise unit is easily foldable, able to be carried about in a gym bag—and only of a weight of some 12 lbs., when fabricated, for example, of stock steel.

7. The spring-controlled extension clamp is constructed with a non-slip material so that it can easily secure to any barbell, dumbbell, pull-up bar, etc., without sliding—and is adaptable to couple with weight bars of between 1 and 1½ in. diameter.

8. With the extension clamp, with the handles, and with the adjustable arm stirrups, many different exercises can be performed—such as arm curls, preacher curls, front raises, chest pull-overs, biceps maneuvers, and a variety of additional lateral movements not easily doable with present equipment, amongst others.

As will be seen from the following description, the spring-controlled extension clamp, in a preferred embodiment of the invention, is of a length of 6 in. measured from the center of the clamp to the center line of the opposing left-and-right handles. In this preferred construction, the clamp is configured tubular (and of a 1 to 1 ½ in. inner diameter), with a finger control actuation for the clamp available while holding a handle in actuating the clamp open or closed. The adjustable arm stirrup is spring-loaded, to vary the degree of lateral movement available to the elbows in controlling the pressure and stresses on their joints. As will also be seen, the arm stirrups and handles are padded for comfort.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
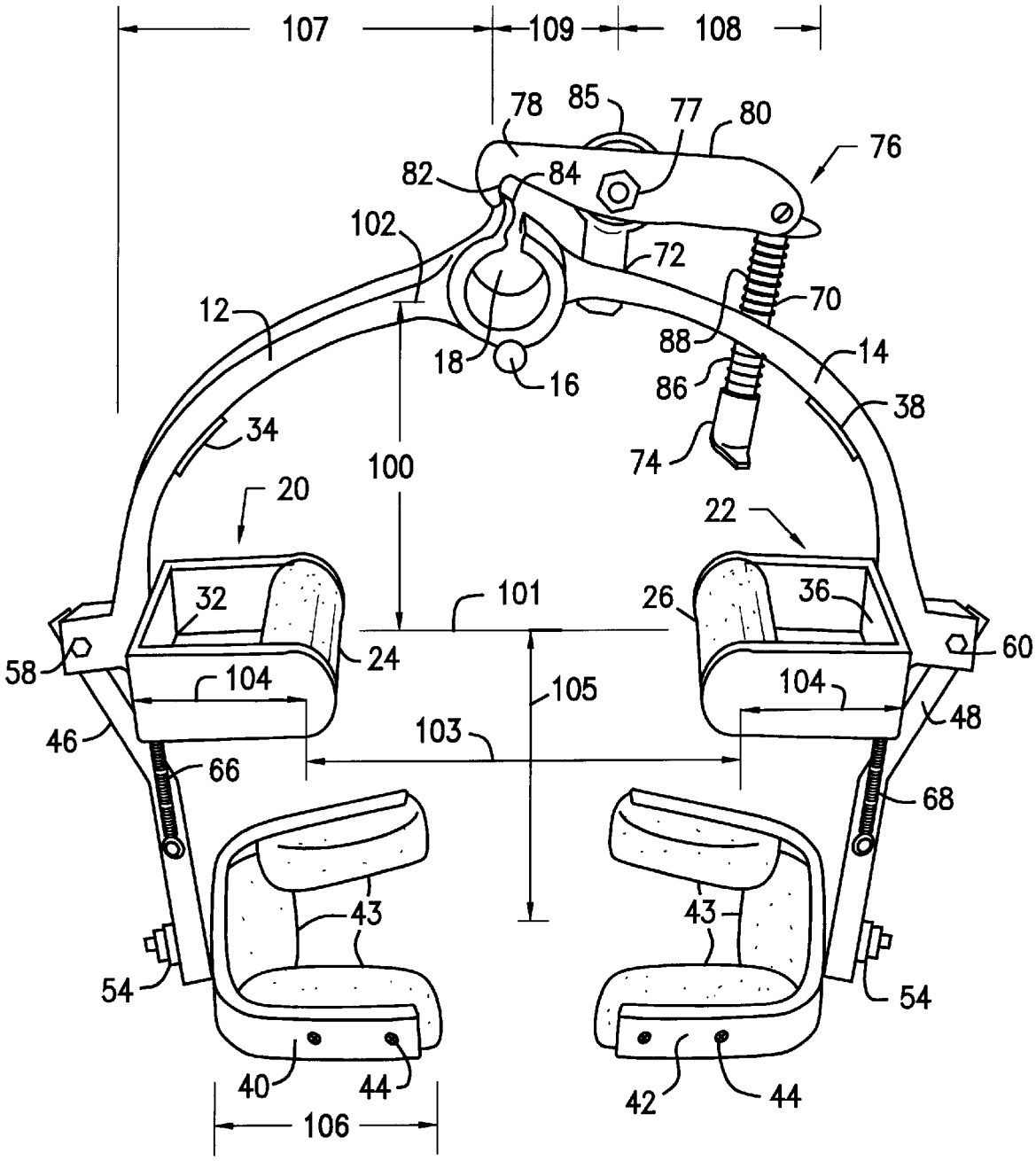
FIG. 1 is a perspective view of the fitness exercise unit of the present invention as it would appear in its clamped, closed position.

In the drawings a pair of essentially mirror-image extension bars are shown, 12, 14, arranged to overlap adjacent to their ends 15, to be hinged together there by means of a pin 16. As shown, each of the bars 12, 14 terminates in a semicircular configuration 17 so as to provide a tubular appearance 18 when closed (FIG. 1). A non-slip surface 19 is arranged to be adhesively secured in any appropriate manner to the inside of each semicircular configuration. Each extension bar 12, 14 is arranged to terminate in a wrist support 20, 22, incorporating a handle 24, 26, for the user to grasp both on the left and right. Such handle 24, 26 is padded for ease of comfort, and also by a non-slip surface. Added protection for the knuckles of the hand and for the fingers when unfurled is shown by the padding at 32, 34 for the left-hand bar 12, and by the padding at 36, 38 for the right-hand bar 14, although the designations "left" and "right" can be reversed due to the mirror-image orientation of the two bars. In a preferred embodiment of the invention, the distance 100 between an imaginary center line extension 101 of the supports 20, 22 and a center line 102 of the semicircular configuration 17 may be of the order of some 6 in.(FIG. 1). As will be readily appreciated, the materials selected for covering the handles 24, 26 for the non-slip surface 19 and for the paddings 32, 34, 36 and 38 may be of any appropriate fabrication.

Also shown in the drawings are a pair of adjustable arm stirrups 40, 42 padded on the inside by any acceptable material 43, secured there in any appropriate manner, as by screws 44. Such stirrups 40, 42 are shown as being three-sided, for the forearms to extend through in grasping onto the padded handles 24, 26. A pair of coupling arms 46, 48 connect the stirrups 40, 42 to the wrist supports 20, 22, by a join which allows for a 360 degree rotation of the stirrups 40, 42 (as into-and-out of the plane of the paper respectively). In the preferred embodiment depicted in the drawings, a pair of bolts 50, 52 extend outwardly through the stirrups 40, 42, through a washer 53, an aperture 54 at a lower end of each coupling arm, and through a second washer 55 to receive a tightening nut 56. At the upper end of the coupling arms 46, 48, further bolts 58, 59 are provided, to extend through an aperture 59, 60 in each extension bar 12, 14, to pass through a like aperture at an upper end of the coupling arms 46, 48, and to be secured in place there by a further pair of nuts 61. A pair of eye-bolts 62, 64 extend through yet a further aperture midway along the length of the coupling arms 46, 48, to receive one end of springs 66, 68, the other end of which ties to an aperture adjacent the wrist support 20, 22, preferably provided at a point beneath the padded surfaces 32, 36. A further nut 67 secures the eye-bolts 62, 64 in position. With this construction, then, the wrists are held in neutral position grasping the handles 24, 26, without pronation or supination, merely by moving the forearms inwardly or outwardly against the biasing of the springs 66, 68.

Figure 2:
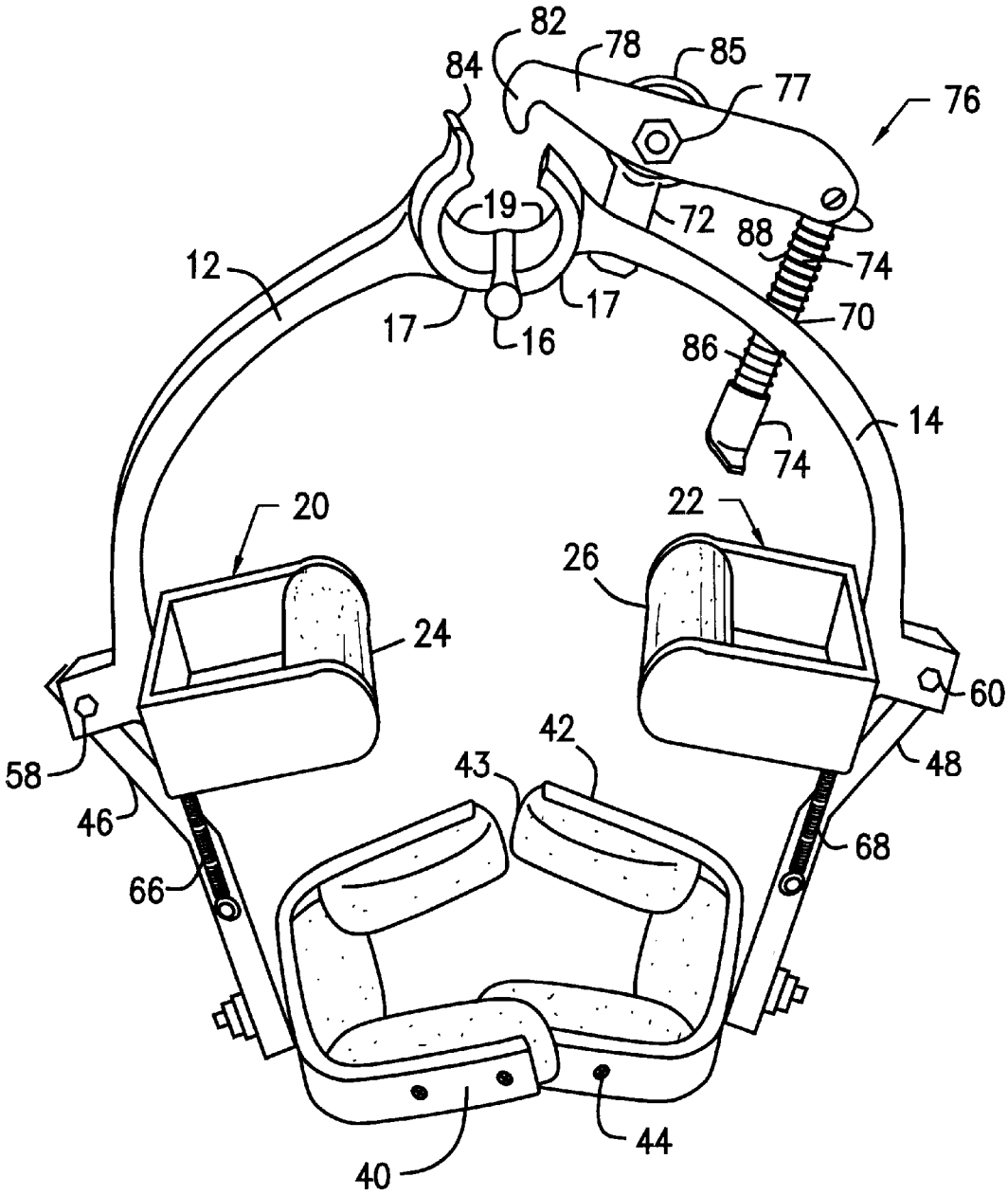
FIG. 2 is a perspective view of the exercise unit in its unclamped, open position.
Figure 3:
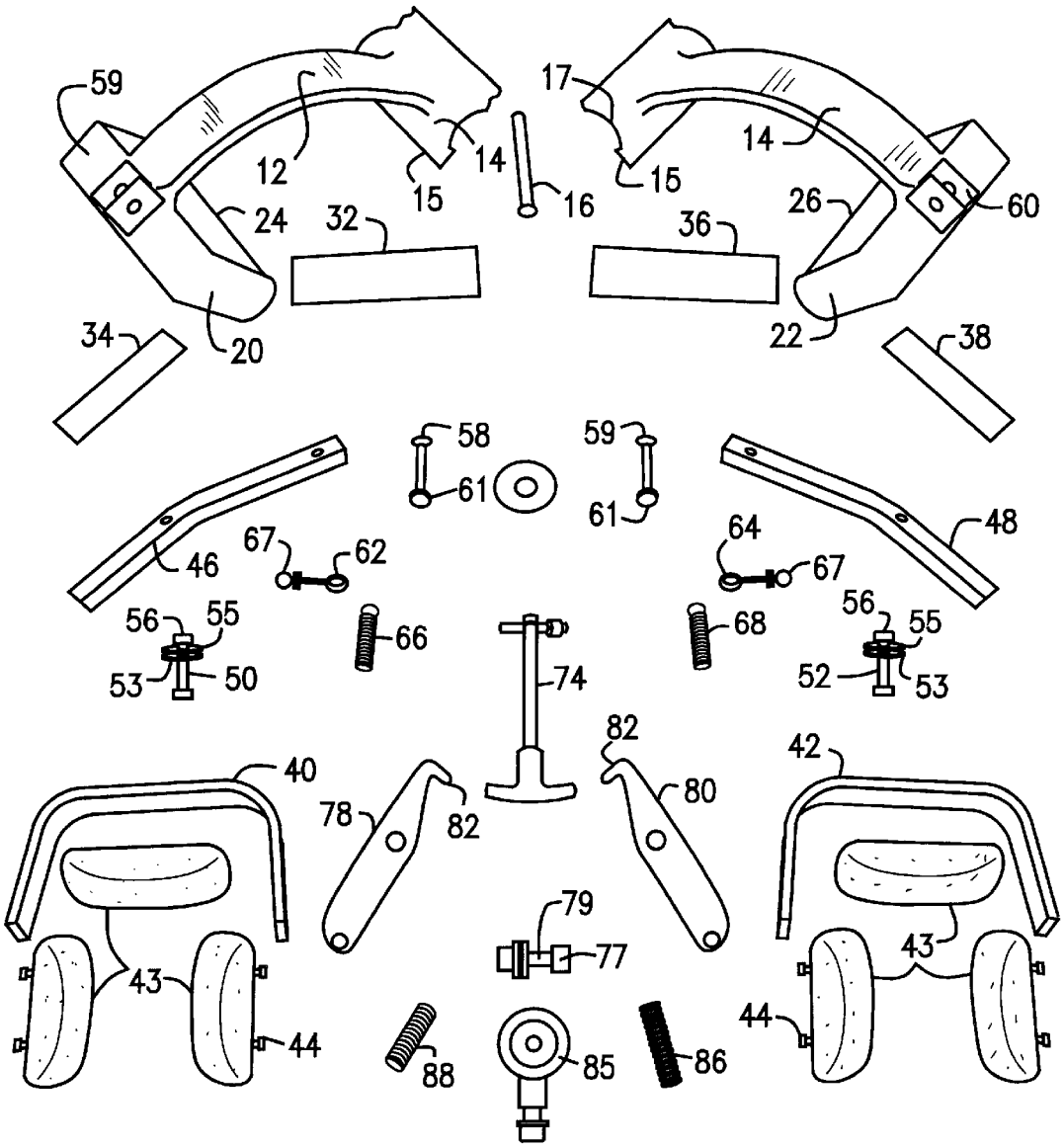
FIG. 3 is a break-away view of the component parts which, when assembled, give the appearance of the fitness exercise unit of FIGS. 1 and 2.

In accordance with the teachings of the invention, a pair of further apertures 70, 72 are cut within one or the other of the extension bars 12, 14—as shown with the bar 14 (FIGS. 1 and 2). Through the first aperture 70, a spring biased finger pull 74 is coupled, to join with a cantilevered gripping plate 76 of front and back sections 78, 80, which are joined together by means of a bolt 79 and nut 77 within a fulcrum 85 in coupling with the second aperture 72 in the bar 14. As shown, the gripping plates 76 terminate in a downwardly extending projection 82, adjacent a raised wall 84 on an upwardly extending section of the opposite bar 12 at its semicircular configuration 17. With the fulcrum action afforded by the downward movement of the finger pull 74, the projection 82 on the two plates 78, 80 raises away from the wall 84 in allowing separation of the tubular clamp brought about by the movement of the hands pulling the wrist supports 20, 22 closer together (FIG. 2). Correspondingly, moving the hands and the wrist supports 20, 22 further apart by grasping and then releasing the finger pull 74 effectively lowers the projections 82 onto the wall 84 and closes the clamp (FIG. 1).

As will be appreciated, then, grasping the finger pull 74 while moving the arms act in a direction to free the tubular clamp 18 from its coupling with any dumbbell, barbell, pull-up bar, etc., while releasing the finger pull 74 is in a direction to effect coupling once again. To facilitate this, a pair of biasing springs 86, 88 are provided on the finger pull 74, one of either side of the aperture 70 and the extension bar 14 through which the finger pull 74 passes.

While Applicant does not wish to be limited to any particular set of values, the following have proved useful in one construction of the invention, fabricated out of stock steel:

Dimension 103 . . . 8 inches
Dimension 104 . . . 2 ½ inches
Dimension 105 . . . 6 inches
Dimension 106 . . . 3 ½ inches
Dimension 107 . . . 6 ½ inches
Dimension 108 . . . 3 inches
Dimension 109 . . . 2 inches With the extension bars 12, 14 extending forwardly of the wrist supports 20, 22 (dimension 100), the lever arm which results increases the resistance of any weight, for example, being held within the tubular clamp 18 and exercised with, yet without increasing the weight being held, to begin with. At the same time, even for the same initial weight, the movement that results is such as to decrease the point in the exercise at which the resistance first is felt, to thereby increase the range against which the musculature works. With the wrist supports and adjustable stirrups, an exercise can be had then either going upwardly, or downwardly, with the arms, doing whatever type of maneuver is desired, without increasing any stress on the wrists, while allowing a greater range of motion for an extended weight. With the arrangement, therefore, one can proceed to do bend-over rows, squats, or a wide variety of lateral movements, without the need to bend over as much, since the center of gravity is moved underneath the user, instead of being out forwardly. When doing a "bar squat" or a "machine squat", as an example, a significant reduction in stress on the lumbar muscles is afforded—as contrasted with proceeding in normal circumstances, without having the added extension or fulcrum benefits of the invention.

Additionally, with the fitness exercise unit as shown, one does not have to change pins, or locks, or weights in proceeding from exercise to exercise (as is traditional with a Selectorize Machine, for example) . All that becomes necessary with the invention is to trigger the finger pull 74 when going from piece to piece, or weight-to-weight, without stopping, and without letting go of the hands. This follows just from the pulling, the latching onto, and the subsequent release of the piece or weight unit in question within the tubular clamp 18. Also, freeing the finger pull 74 opens up the extension clamp, so that the fitness exercise unit can be folded over into the configuration of FIG. 2, thereby allowing it to more easily be folded into a gym bag for carrying about. With the non-slip materials on the clamp 18, and on the handles 24, 26, any possible slippage in use is reduced, in allowing for increased safety to the joints otherwise stressed during the exercise movement. With the forearm bracing stirrups 40, 42, a wide variety of lateral movements can be undertaken, all with the quick-locking mechanism in place to allow going from one piece of exercise equipment to the next.

While there have been described what are considered to be preferred embodiments of the present invention, it will be readily appreciated by those skilled in the art that modifications can be made without departing from the scope of the teachings herein. Thus, while the fitness exercise unit has been described as being preferably made of stock steel, any type of material could be used—and, whether the paddings are used as set forth, modified, or eliminated. Similarly, the construction of the fulcrum arrangement 85 for opening or closing the tubular clamp 18 illustrates just what is believed to be a preferred construction at the present time, although other arrangements could be visualized for modifying this, as long as a finger pull trigger access is present. For at least such reasons, resort should be had to the claims appended hereto for a true understanding of the scope of the invention.

I claim:

1. A fitness exercise unit comprising:

first and second extension bars joined together at adjacent ends thereof;

first and second elongated handle members inwardly extending towards one another from respective ones of said first and second bars at a first location thereon measured with respect to the position of said join;

first and second stirrups coupled to said first and second bars at a second location thereon, farther from said position of said join than said first location;

said join being a point on said adjacent ends of said extension bars which form a substantially closed tubular clamp when brought together and which form a substantially open tubular clamp when separated;

means on one of said extension bars for actuating said join to said closed and said opened clamp position; and with said means being actuable by the fingers of the hand grasping the elongated handle member of that said one extension bar.

2. The fitness exercise unit of claim 1 wherein said stirrups are self-adjustably rotatable in orientation.

3. The fitness exercise unit of claim 2 wherein said stirrups are constructed of three sides each, opened adjacent to each other.

4. The fitness exercise unit of claim 1 wherein said first and second extension bars are hinged together, with said other of said extension bars including a raised surface to be grasped in actuating said join between said opened and closed positions.

5. The fitness exercise unit of claim 1 wherein said first and second elongated handle members are at a first location substantially 6 inches from the position of said join.

6. A fitness exercise unit comprising:

a first extension bar having an end termination of semicircular configuration;

a second extension bar having an end termination of semicircular configuration, and also having a raised wall surface at an upper end thereof;

first means joining together lower ends of both said semicircular end terminations;

first and second elongated handle members inwardly extending towards one another from respective ones of said first and second bars at a first location thereon measured with respect to the position at which said lower ends of both said semicircular end terminations are joined together;

first and second stirrups coupled to said first and second extension bars at a second location thereon, further from said position at which both said semicircular end terminations are joined together;

second means on said first extension bar for coupling to said raised wall surface on said second extension bar for actuating said semicircular end terminations toward and away from one another in closing and opening said terminations; and with said second means being actuable by the fingers of the hand grasping the handle member of said first extension bar.

7. The fitness exercise unit of claim 6 wherein said stirrups are adjustably rotatable in orientation.

8. The fitness exercise unit of claim 7 wherein said stirrups are constructed of three sides each, opened adjacent to each other.

9. The fitness exercise unit of claim 6 wherein said first and second elongated handle members are at a first location substantially 6 inches from the position of said join.

* * * * *